US010184497B2

(12) United States Patent
Maurer

(10) Patent No.: US 10,184,497 B2
(45) Date of Patent: Jan. 22, 2019

(54) UNIVERSAL ORIENTATION ELECTRO-HYDRAULIC ACTUATOR

(71) Applicant: Parker-Hannifin Corporation, Cleveland, OH (US)

(72) Inventor: Garrett Mitchell Maurer, Wolverton, MN (US)

(73) Assignee: Parker-Hannifin Corporation, Cleveland, OH (US)

( * ) Notice: Subject to any disclaimer, the term of this patent is extended or adjusted under 35 U.S.C. 154(b) by 236 days.

(21) Appl. No.: 15/193,366

(22) Filed: Jun. 27, 2016

(65) Prior Publication Data

US 2017/0002842 A1 Jan. 5, 2017

Related U.S. Application Data

(60) Provisional application No. 62/186,859, filed on Jun. 30, 2015.

(51) Int. Cl.
*F15B 1/26* (2006.01)
*F15B 15/18* (2006.01)

(52) U.S. Cl.
CPC ..... *F15B 1/265* (2013.01); *F15B 15/18* (2013.01); *F15B 2211/20515* (2013.01); *F15B 2211/20561* (2013.01); *F15B 2211/27* (2013.01); *F15B 2211/625* (2013.01)

(58) Field of Classification Search
CPC .... F15B 1/265; F15B 15/18; F15B 2211/625; F15B 2211/27; F15B 2211/20561; F15B 2211/20515
See application file for complete search history.

(56) References Cited

U.S. PATENT DOCUMENTS

| | | | | |
|---|---|---|---|---|
| 3,024,875 | A | 3/1962 | Stultz | |
| 3,817,034 | A | 6/1974 | Nott | |
| 4,052,852 | A * | 10/1977 | Hart | F15B 1/265 138/30 |
| 4,793,381 | A | 12/1988 | Sugimura | |
| 4,907,621 | A | 3/1990 | Sugimura et al. | |
| 7,055,317 | B2 | 6/2006 | Knapp et al. | |
| 8,434,524 | B2 | 5/2013 | Barth et al. | |
| 2004/0047747 | A1 * | 3/2004 | Hsu | F04B 9/127 417/375 |

(Continued)

FOREIGN PATENT DOCUMENTS

CN 203453148 U 2/2014

*Primary Examiner* — Thomas E Lazo
(74) *Attorney, Agent, or Firm* — Renner, Otto, Boisselle & Sklar, LLP

(57) ABSTRACT

An electro-hydraulic actuator is operable in any orientation without changing components. The electro-hydraulic actuator includes a reservoir for containing a hydraulic fluid, a bladder within the reservoir for containing a compressible gas, a pump fluidly connected to the reservoir with one or more inlet/outlet ports, and an electric motor drivingly coupled to the pump. The bladder has an inlet/outlet port configured to communicate with a gas source external to the reservoir for adjusting the amount of compressible gas within the bladder. The bladder may also be configured within the reservoir in a manner that prevents the bladder from obstructing fluid flow to the pump inlet/outlet, and that can also prevent fluid from becoming trapped by the bladder and therefore inaccessible to the pump.

20 Claims, 2 Drawing Sheets

(56) References Cited

U.S. PATENT DOCUMENTS

| | | | | |
|---|---|---|---|---|
| 2006/0083635 | A1 | 4/2006 | Yueh | |
| 2010/0300279 | A1* | 12/2010 | Kadlicko | F15B 15/18 91/361 |
| 2012/0067035 | A1* | 3/2012 | Sweeney | F15B 15/18 60/325 |

* cited by examiner

UNIVERSAL ORIENTATION ELECTRO-HYDRAULIC ACTUATOR

RELATED APPLICATIONS

This application claims the benefit of U.S. Provisional Application No. 62/186,859 filed Jun. 30, 2015, which is hereby incorporated herein by reference in its entirety.

FIELD OF INVENTION

The present invention relates generally to electro-hydraulic actuators, and more particularly to an electro-hydraulic actuator that can be used in any orientation.

BACKGROUND

Self-contained power units, such as electro-hydraulic actuators, typically include an electric motor that drives a hydraulic pump to move fluid between a reservoir and a hydraulic actuator. The hydraulic actuator generally includes a tubular barrel in which a piston having a piston rod moves linearly, back and forth. The piston seals separate the inside of the barrel into two chambers, a fluid chamber and a piston chamber. The fluid chamber generally is filled with a substantially incompressible hydraulic fluid, typically an oil.

The pressure of hydraulic fluid pumped into or out of the fluid chamber moves the piston within the barrel. In general, when the electric motor is driven in a first rotational direction, the hydraulic pump moves the fluid into the fluid chamber of the hydraulic actuator and out of the piston chamber, thereby extending a piston rod from the actuator housing. When the electric motor is driven in a second rotational direction, opposite the first rotational direction, the hydraulic pump moves the hydraulic fluid into the piston chamber and out of the fluid chamber, thereby retracting the rod.

As the piston rod extends and retracts, the hydraulic pump moves fluid into and out of the reservoir, for example, through one or more inlet/outlet ports located at the bottom of the fluid reservoir. In some systems, the volume of fluid flowing into or out of the reservoir is displaced with a volume of compressible gas within the reservoir. However, if this compressible gas is able to enter the pump, then poor pump performance (e.g., cavitation) and/or the inability of the piston rod to hold a load may occur. Therefore, some systems may provide a bladder within the reservoir that separates the pocket of gas from the pump inlet/outlet to prevent the gas from entering the pump.

In some systems, the bladder is free floating within the reservoir. If the bladder comes into contact with the pump inlet/outlet, then the bladder may obstruct fluid flow to the pump and cause degradation in pump performance, or even destroy the bladder. In other instances, the bladder may seal against the interior surfaces of the reservoir, causing some of the hydraulic fluid to become trapped behind the bladder, which makes the fluid inaccessible to the pump. This may cause the pump to draw a vacuum, which prevents the pump from supplying hydraulic fluid to the actuator and may also cause cavitation.

Still another concern is that the pressure of the compressible gas within the bladder may change over time due to cyclical loading and/or environmental factors. If the pressure of the compressible gas within the bladder drops below a certain level, a partial vacuum may be created within the reservoir that may cause the detrimental effects and poor pump performance discussed above. Such a change in the required reservoir pressure may be particularly problematic because, once the electro-hydraulic actuator has been assembled and installed, it is generally very difficult to replace or maintain.

SUMMARY OF INVENTION

The present invention provides an electro-hydraulic actuator (EHA) having a bladder that contains a compressible gas within a fluid reservoir for accommodating changes in the hydraulic fluid volume within the reservoir, and which prevents the gas from entering a pump connected to the reservoir, regardless of the orientation of the EHA. In particular, the bladder is configured to allow the amount of compressible gas within the bladder to be adjustable after assembly and throughout the life of the EHA. The adjustability of the compressible gas within the bladder enhances tailorability in design, improves maintenance time, and may reduce unnecessary repairs associated with the EHA. The bladder may also be configured within the reservoir such that the bladder does not restrict hydraulic fluid communication with the pump, so as to avoid pump performance issues. For example, the bladder may be positioned within the reservoir to prevent blockage of the pump inlet/outlet, and may also be configured to prevent fluid from being trapped behind the bladder and causing a vacuum effect.

According to an aspect of the invention, an electro-hydraulic actuator includes a reservoir having an interior space for containing a hydraulic fluid, a bladder within the reservoir that is configured to contain a compressible gas and configured to communicate with a gas source external to the reservoir, a closure configured to close communication of the inlet/outlet port of the bladder with the external gas source for retaining the compressible gas within the bladder, a pump fluidly connected to the reservoir having one or more inlet/outlet ports in fluid communication with the reservoir, and an electric motor drivingly coupled to the pump.

Embodiments of the invention may include one or more of the following additional features.

For example, the bladder may have an inlet/outlet port configured to communicate with the gas source external to the reservoir.

In some embodiments, a passage operatively connects the bladder inlet/outlet port with the external gas source.

In some embodiments, the passage may be a through-passage in a wall of the reservoir. In other embodiments, the passage may be a passage through a tube or other structure.

In some embodiments, a conduit operatively connects the bladder inlet/outlet port with the external gas source, the conduit extending from inside of the reservoir to outside of the reservoir.

For example, the conduit may span a wall of the reservoir, or the conduit may extend from the wall toward the inside and/or outside of the reservoir. In other examples, the conduit may be flexible or rigid.

In some embodiments, the conduit is attached to the bladder and positions the bladder within the reservoir such that the bladder is spaced from the pump inlet/outlet.

For example, the spacing between the bladder and pump inlet/outlet may be sufficient to prevent the bladder from blocking flow to the pump inlet/outlet regardless of the orientation of the EHA, and regardless of the amount of fluid in the reservoir.

In some examples, the bladder may be rigidly anchored to a wall of the reservoir, such as a wall opposite the pump inlet/outlet, to prevent the bladder from contacting the pump inlet/outlet.

In some embodiments, the reservoir has a region for containing hydraulic fluid proximal the pump inlet/outlet and a region for containing hydraulic fluid distal the pump inlet/outlet, and the bladder may be configured within the reservoir to enable the hydraulic fluid proximal the pump inlet/outlet to communicate with the hydraulic fluid distal the pump inlet/outlet.

For example, the bladder may have grooves, channels, or corrugations in its outer surface for enabling flow of hydraulic fluid past the bladder.

In some embodiments, the conduit is attached to the bladder and positions the bladder within the reservoir such that hydraulic fluid proximal the pump inlet/outlet is communicable with the hydraulic fluid distal the pump inlet/outlet.

For example, the bladder may be connected in the reservoir in a manner that limits contact of the outer surface of the bladder with the inner surface of the reservoir.

In some embodiments, the conduit is a rigid stem extending through an outer wall of the reservoir, the rigid stem being sealingly secured to the reservoir.

The rigid stem may anchor the bladder within the reservoir in a manner that prevents the bladder from sealingly engaging the inner surface of the reservoir.

In some embodiments, the fluid passage and/or conduit includes a valve for controlling passage of the gas into or out of the bladder.

For example, the closure configured to close communication of the inlet/outlet port of the bladder with the external gas source may include a valve.

In some embodiments, the external gas source is a source of compressed gas. The source of compressed gas may be one or more of a gas compressor, a compressed gas tank, or other suitable compressed gas sources.

In other embodiments, the external gas source may be the environment external to the reservoir.

In some embodiments, the pressure level of the compressible gas within the bladder is adjustable. In particular, the pressure level within the bladder may be adjustable without having to remove the bladder from the reservoir.

For example, the pressure of the compressible gas within the bladder may be set at an initial pressure level during assembly or installation of the EHA, and may thereafter be adjusted to a level different from the initial pressure level.

In some instances, the pressure level of the compressible gas within the bladder may be adjustable to accommodate for different volumes of hydraulic fluid that enter or exit the reservoir.

For example, the pressure level of the compressible gas within the bladder may be adjusted to accommodate any number of actuator designs, such as different piston rod sizes, different fluid chamber sizes, among other considerations.

In some instances, the initial pressure level of the compressible gas within the bladder may decrease or increase due to use, time, and/or environmental factors, and the pressure level may be adjusted back to the initial pressure level.

In some embodiments, the compressible gas within the bladder is pressurized to an elevated pressure level sufficient to maintain an elevated pressure of the hydraulic fluid in the reservoir even when the level of hydraulic fluid in the reservoir is at a minimum.

For example, the elevated pressure level of the compressible gas within the bladder may be sufficient to accommodate for changes in pressure due to environmental factors (e.g., temperature, elevation, etc.). In other examples, the elevated pressure level is sufficient to keep the pump primed and to energize the seals in the reservoir. In yet other examples, the elevated pressure level is sufficient to minimize fatigue loading.

In some embodiments, the bladder is made of a compressible material, for example, an elastomeric material, such as rubber.

In some embodiments, a coupling connects the electric motor to the pump, and the pump is located within the reservoir.

The EHA also includes an actuator, for example, a piston-cylinder assembly having a piston axially movable within the cylinder that is in fluid communication with the pump to effect movement of the piston in response to fluid flow between the cylinder and the reservoir.

According to another aspect of the invention, an electro-hydraulic actuator includes a vessel having an interior space; a separator element separating the interior space of the vessel into a first portion for containing a hydraulic fluid and a second portion for containing a compressible gas, the separator element having an inlet/outlet port configured to communicate with an environment external to the vessel; a closure configured to close communication of the inlet/outlet port of the separator element with the external environment for retaining the compressible gas within the separator element; a pump connected to the vessel, the pump having one or more inlet/outlet ports communicating with the first portion of the housing; and an electric motor drivingly coupled to the pump.

Embodiments of the invention may include one or more of the following additional features.

In some embodiments, the separation element is shiftable between a first state corresponding to a maximum volume of the first portion and a second state corresponding to a minimum volume of the first portion.

In some embodiments, a conduit operatively connects the separator element inlet/outlet port with the external environment, and the conduit is attached to the separator element and positions the separator element within the vessel such that the separator element is spaced from the pump inlet/outlet.

In some embodiments, the vessel has a region for containing hydraulic fluid proximal the pump inlet/outlet and a region for containing hydraulic fluid distal the pump inlet/outlet, and the separator element is configured within the reservoir to enable the hydraulic fluid proximal the pump inlet/outlet to communicate with the hydraulic fluid distal the pump inlet/outlet.

According to another aspect of the invention, an electro-hydraulic actuator includes a reservoir for containing a hydraulic fluid; a pump fluidly connected to the reservoir, the pump having one or more inlet/outlet ports in fluid communication with the reservoir; an electric motor drivingly coupled to the pump; and a bladder within the reservoir for containing a compressible gas, the bladder being connected in the reservoir in a manner that prevents the bladder from obstructing flow to the pump inlet/outlet.

In some embodiments, the bladder is connected in the reservoir in a manner that prevents the bladder from contacting the pump inlet/outlet, and/or an inlet/outlet in fluid communication with the pump.

In some embodiments, the bladder is anchored within the reservoir with a stem that attaches the bladder to an adjacent wall of the reservoir.

In some embodiments, the bladder is configured within the reservoir such that it is spaced from the interior surfaces of the reservoir for enabling the hydraulic fluid proximal the pump inlet/outlet to communicate with the hydraulic fluid distal the pump inlet/outlet.

The following description and the annexed drawings set forth certain illustrative embodiments of the invention. These embodiments are indicative, however, of but a few of the various ways in which the principles of the invention may be employed. Other objects, advantages and novel features according to aspects of the invention will become apparent from the following detailed description when considered in conjunction with the drawings.

BRIEF DESCRIPTION OF THE DRAWINGS

The annexed drawings, which are not necessarily to scale, show various aspects of the invention.

DETAILED DESCRIPTION

The present invention provides an electro-hydraulic actuator (EHA) that is operable in any orientation without changing components. In particular, the exemplary EHA includes a bladder within a fluid reservoir that contains a volume of compressible gas. The bladder containing the volume (or packet) of gas is adapted to accommodate for changes in hydraulic fluid volume in the reservoir during operation of the EHA. The bladder separates the gas from the hydraulic fluid and prevents the gas from entering a pump. The amount of compressible gas in the bladder is adjustable by allowing gas to enter or exit the bladder through an inlet/outlet port. The bladder may also be configured within the reservoir so as to limit restriction of hydraulic fluid flow to the pump.

The principles of the present invention have particular application to electro-hydraulic actuators and thus will be described below chiefly in this context. It will of course be appreciated, and also understood, that principles of the invention may be applicable to other systems where it is desirable to provide a bladder, or other gas separation member, that is adjustable after assembly and throughout the life of the unit. The principles of the invention may also be applicable to hydraulic systems where it is desirable to configure the bladder within the reservoir so that it does not restrict hydraulic fluid communication with the pump.

In the discussion above and to follow, the terms "upper," "lower," "inner," "outer," "left," "right," "above," "below," "horizontal," "vertical," etc. refer to an exemplary EHA 10 as viewed in the vertical position shown in FIG. 1. This is done realizing that these units, such as when used on vehicles, can be mounted on the top, bottom, or sides of other components, or can be inclined with respect to the vehicle chassis, or can be provided in various other positions. In particular, the exemplary EHA 10 may be operable regardless of whether it is oriented on its right or left side, forward or rearward facing, upside down or right-side up, inclined, etc. More particularly, no changes to the exemplary EHA 10 are necessary to enable it to operate in different orientations. Consequently, the EHA 10 can also operate in conditions where its orientation changes over time. In other words, the EHA 10 can continue to operate as it moves through a range of motions that encompass one or more of the described static orientations, or other orientations therebetween.

Figure 1:
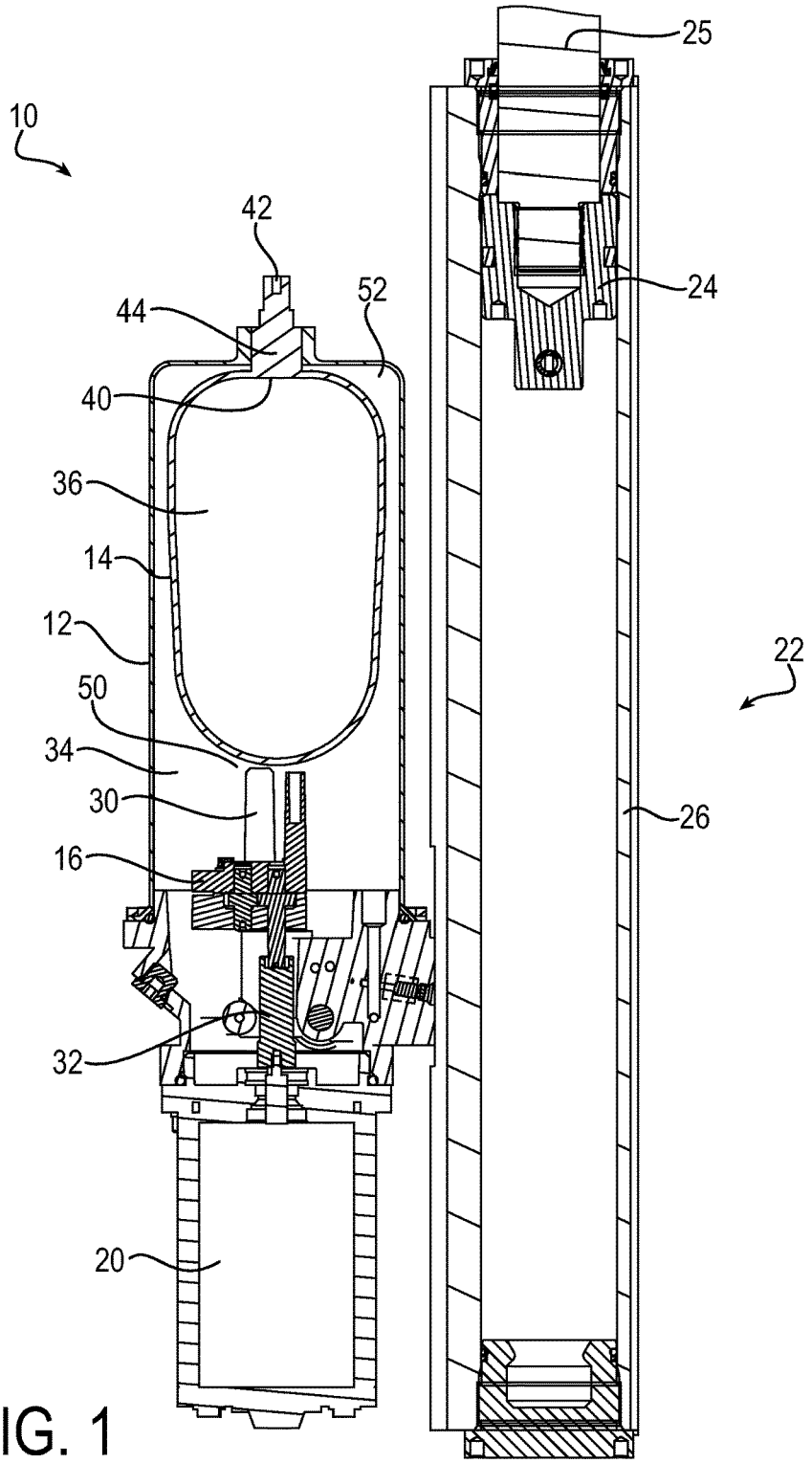
FIG. 1 illustrates a cross-sectional view of an exemplary electro-hydraulic actuator showing a piston rod in an extended position and a reservoir in a minimum volume condition with a bladder that is in an uncompressed state.
Figure 2:
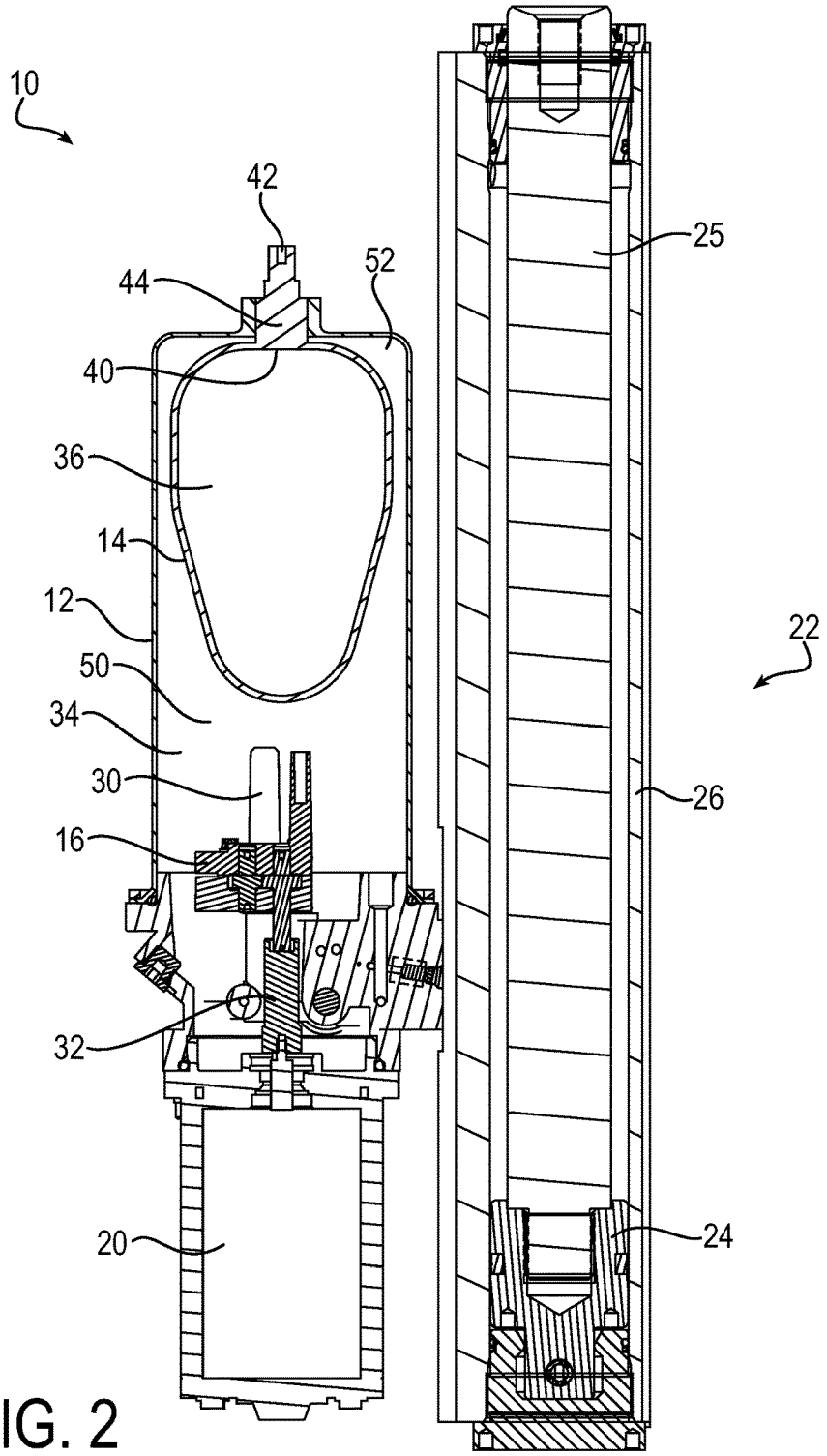
FIG. 2 illustrates a cross-sectional view of the electro-hydraulic actuator of FIG. 1 with the piston rod in the retracted position and the reservoir in a maximum volume condition with the bladder in a compressed state.

Referring now to FIGS. 1 and 2, the illustrated EHA 10 includes a vessel, such as a reservoir 12 having an interior space or other means for containing a hydraulic fluid, a bladder 14 or other means for containing a compressible gas within the reservoir 12, a pump 16 or other means for moving fluid connected to the reservoir 12, an electric motor 20 or other motive means drivingly coupled to the pump 16, and a piston-cylinder actuator assembly 22 having a piston 24 connected to a piston rod 25 axially movable within a cylinder 26, and that is in fluid communication with the pump 16 to effect movement of the piston 24 in response to fluid flow between the cylinder 26 and the pump 16. Other hydraulic actuating means for effecting movement in response to fluid flow can be used in place of such a piston-cylinder actuator assembly.

In the illustrated embodiment, the pump 16 is located within the reservoir 12 and is submerged within the hydraulic fluid contained by the reservoir 12. Alternatively, the pump 16 can be mounted to the outside of the reservoir 12. A coupling 32, which can include a drive shaft, for example, connects the electric motor 20 to the pump 16. An exemplary pump is a gerotor pump. The motor 20 and the pump 16 are reversible, whereby reversing the motor 20 reverses the direction in which the pump 16 moves the fluid.

When the pump 16 is moving hydraulic fluid, typically an oil, from the reservoir 12 to the cylinder 26, the ports 30 act as inlet or intake ports. When the pump 16 is moving hydraulic fluid from the cylinder 26 to the reservoir 12, the ports 30 act as outlet ports. The reservoir 12 generally contains a volume of hydraulic fluid such that when the piston 24 is fully extended, the volume of fluid in the reservoir 12 is at a minimum, and when the piston is fully retracted, the volume of fluid in the reservoir 12 is at a maximum.

In the illustrated embodiment, the inlet/outlet ports 30 communicate with a volumetric centroid region of the reservoir 12. Thus, even when the volume of fluid in the reservoir 12 is at a minimum, the inlet/outlet ports 30 remain submerged in fluid. The inlet/outlet ports 30 may also be optimized in size and shape to ensure that the inlet/outlet ports 30 are submerged in hydraulic fluid regardless of orientation of the EHA 10 and regardless of the piston diameter-stroke length combinations.

Due to the differential volume of hydraulic fluid in the cylinder 26 between the piston 24 in an extended state (shown in FIG. 1) and a retracted state (shown in FIG. 2), a pocket of air (or other compressible gas) is contained by the bladder 14 inside of the reservoir 12. The bladder 14 generally is made of a flexible material that is impermeable to the compressible gas, for example, an elastomeric material such as rubber. The bladder 14 is configured to accommodate for the varying volumes of hydraulic fluid in the reservoir 12, such that the volume of the compressible gas in the bladder 14 is related to the position of the piston 24 in the cylinder 26.

For example, as the piston 24 moves from a fully extended condition to a fully retracted condition, the pump 16 moves hydraulic fluid into the reservoir 12, and the volume of the compressible gas within bladder 14 is compressed, as illustrated by the shifting and distortion of the bladder 14 in FIG. 2. Similarly, as the piston 24 moves from the fully retracted condition to the fully extended condition, the pump 16 moves hydraulic fluid out of the reservoir 12, and the volume of the compressible gas in the bladder 14 expands, as illustrated in FIG. 1. In this manner, the bladder 14 is shiftable between a first state (FIG. 2) corresponding to a maximum volume of hydraulic fluid in the reservoir 12, and a second state (FIG. 1) corresponding to a minimum volume of hydraulic fluid in the reservoir 12. The maximum internal reservoir pressure generally is limited by the ability of a seal on the coupling 32, or other seal of the reservoir 12, to maintain a seal and retain the hydraulic fluid in the reservoir 12. This typically results in an appreciable volume of compressible gas being used in the bladder 14 to compensate for the differential volume in the cylinder 26 in conjunction with movement of the piston 24.

Regardless of the EHA's orientation, the pump inlet/outlet port 30 should be submerged in hydraulic fluid and should not be exposed to the pocket of compressible gas. Exposing the inlet/outlet port 30 to the pocket of compressible gas could result in cavitation of the pump 16, or the pump introducing the compressible gas into the hydraulic circuit, which may lead to compressibility in the cylinder 26 and ultimately may compromise the safety and reliability of the EHA 10.

To permit the EHA 10 to be used in any orientation, the bladder 14 is configured to completely contain the compressible gas within the reservoir 12 and prevent the gas from entering the pump 16. More particularly, the bladder 14 may be considered as a separation member that separates the interior space of the reservoir 12 into a first portion 34 for containing the hydraulic fluid and a second portion 36 for containing the compressible gas. In this manner, the pump 16 is connected to the reservoir 12 and one or more of the inlet/outlet ports 30 communicate with the hydraulic fluid in the first portion 34 that is separated from the gas in the second portion 36. Most, if not all, of the compressible gas in the reservoir 12 is contained within and completely enclosed by the bladder 14, which keeps the volume of compressible gas isolated from the pump inlet/outlet ports 30. Preventing the gas from becoming entrained in the hydraulic fluid may also reduce vortexing of the fluid, for example, around the coupling 32 as it spins.

Further, certain design considerations, such as various piston rod sizes, stroke length, piston diameters, etc., result in different hydraulic fluid volumes flowing into and out of the reservoir 12, which thereby varies the prescribed volume and/or amount of compressible gas in the bladder 14. To account for this design variability and provide different amounts of compressible gas in the bladder 14, the bladder 14 is configured to be adjustable, such that gas may enter or exit the bladder 14 via an inlet/outlet port 40 or other means for communicating with a gas source external to the reservoir 14. More particularly, the amount of compressible gas within the bladder 14 corresponds to a pressure, mass, and/or volume of gas that is adjustable without having to remove the bladder 14 from the reservoir 12. The external gas source may be a compressed gas source, for example, from a gas (e.g., air) compressor and/or a compressed gas (e.g., nitrogen or air) tank. The external gas source may also be the environment external to the reservoir.

In the illustrated embodiment, a passage 42 operatively connects the bladder inlet/outlet port 40 with the external gas source. The passage may be a through-passage in a wall of the reservoir, or the passage may be a passage through a tube or other structure. For example, in the exemplary illustration, a conduit 44 having internal passage 42 connects the bladder inlet/outlet port 40 with the external gas source. The conduit 44 may be configured as a rigid stem extending through an outer wall of the reservoir 12 and sealingly secured to the reservoir 12, as shown, or the conduit 44 may be flexible.

A closure may be configured for closing communication of the bladder inlet/outlet port 40 with the external gas source and also for retaining the compressible gas within the bladder 14. The closure may be located on the bladder inlet/outlet port 40, for example as a flap, and/or may be located along the passage 42, for example as a plug or valve. The closure may selectively be opened for permitting flow of compressible gas into or out of the bladder 14, as will be discussed below. For example, the conduit 44 may include a self-contained spring-biased valve for controlling passage of the compressible gas into or out of the bladder 14.

During or after assembly of the EHA 10, the pressure level of the compressible gas within the bladder 14 may be set at an initial pressure level, and may thereafter be adjusted to a level different from the initial pressure level by allowing gas to enter or exit the bladder 14 via the inlet/outlet port 40. For example, the initial pressure level of the compressible gas may be set at about 1 atmosphere at standard conditions. In some instances, however, the initial pressure level of the compressible gas may decrease, for example, if the temperature in which the EHA 10 is used decreases in accordance with the ideal gas law. If the pressure of the compressible gas within the bladder 14 decreases enough, a partial vacuum may be created in the reservoir 12, which may restrict fluid flow and cause cavitation of the pump 16. To prevent cavitation and other detrimental effects, the bladder 14 may initially be filled with an elevated pressure level of the compressible gas (e.g., above 1 atmosphere, such as between 1 atm to 2 atm) that is sufficient to accommodate for changes in pressure due these environmental factors, among other considerations.

In addition, the pressure level of the compressible gas within the bladder 14 may change over the life of the EHA 10, for example, due to wear of components and/or escape of the compressible gas. By providing a bladder 14 in which the pressure level of compressible gas may be adjusted back to the initial pressure level, or to a prescribed pressure level based on the EHA's requirements, may prevent detrimental effects and extend the useful life of the EHA 10 without requiring unnecessary repairs. In particular, since the pressure level of the compressible gas within the bladder 14 is adjustable without removing the bladder 14 or uninstalling the EHA 10, the maintenance procedures and/or time to repair the EHA 10 may also be improved.

Furthermore, by setting the pressure level of the compressible gas within the bladder 14 to an elevated pressure level as stated above, the hydraulic fluid within the reservoir 12 may also be slightly pressurized even when the level of hydraulic fluid in the reservoir 12 is at a minimum (e.g., when the piston 24 is in a fully extended state). Maintaining a pressurized reservoir 12 vis-a-vis a pressurized bladder 14 may help to keep the pump 16 primed for enabling better performance of the pump 16, and may improve response time for extension and retraction of the piston 24. Moreover, pressurizing or "charging" the reservoir 12 by applying an elevated pressure to the bladder 14 may also improve reservoir sealing by energizing the seals in the reservoir 12 at all times.

In addition, since the pressure within the reservoir 12 may cycle millions of times throughout the life of the EHA 10, pressurizing the bladder 14 and reservoir 12 to an elevated pressure level (as stated above) may reduce the magnitude of stress change between the maximum and minimum fill states during cyclic loading of the reservoir 12. In other words, by providing a positive pressure in the reservoir 12 at all times, the magnitude of the change in stress in the reservoir may be reduced, thereby reducing fatigue of the reservoir 12 and improving the life of the EHA 10.

Still referring to FIGS. 1 and 2, the bladder 14 may also be connected in the reservoir 12 in a manner that prevents the bladder 14 from contacting the pump inlet/outlet 30 and causing fluid blockage to the pump 16. In the illustrated embodiment, the conduit 44 is attached to the bladder 14 and positions the bladder 14 within the reservoir 12 such that the bladder 14 is spaced from the pump inlet/outlet 30. More particularly, the bladder 14 is anchored within the reservoir 12 with the conduit 44, which attaches a portion of the bladder 14 opposite the pump inlet/outlet 30 to an adjacent wall of the reservoir 12. The conduit 44 may be a rigid stem that rigidly fixes the bladder 14 in the reservoir 12 away from the pump inlet/outlet 30. The spacing between the bladder 14 and pump inlet/outlet 30 may be sufficient to prevent the bladder 14 from blocking flow to the pump inlet/outlet 30 regardless of the orientation of the EHA 10, and regardless of the amount of fluid in the reservoir 12.

The bladder 14 may also be configured within the reservoir 12 in a manner that reduces a vacuum effect by enabling the hydraulic fluid surrounding the bladder 14 to communicate with the pump inlet/outlet 30. In the illustrated embodiment, the reservoir 12 has a region 50 for containing hydraulic fluid proximal the pump inlet/outlet 30 and a region 52 for containing hydraulic fluid distal the pump inlet/outlet 30 (e.g., in the corners behind the bladder 14). If the hydraulic fluid in the regions 52 distal from the pump inlet/outlet 30 becomes trapped behind the bladder 14 and inaccessible to the pump 16, then the pump 16 may draw a vacuum which prevents the pump 16 from moving hydraulic fluid into the cylinder 26 and causes cavitation. Thus, in some embodiments, the bladder 14 may be configured within the reservoir 12 such that the radially outer surface of the bladder 14 does not sealingly engage the radially inner surface of the reservoir 12 in a way that causes the foregoing vacuum effect. The conduit 44 may be rigidly attached to the bladder 14 to anchor the bladder 14 within the reservoir 12 such that the bladder 14 does not contact the interior surface of the reservoir 12 in this manner. The bladder 14 may also be configured with grooves, channels, or corrugations in its outer surface for enabling flow of hydraulic fluid from distal region 52, past the bladder 14, to proximal region 50, and vice versa.

An exemplary EHA has been described that enhances tailorability in actuator design by providing an adjustable bladder that can accommodate for differences in hydraulic fluid volumes, that improves maintenance procedures by allowing the bladder to be adjusted without having to uninstall the EHA 10, and that may reduce unnecessary repairs associated with the EHA by pressurizing the bladder to improve sealing function, reduce fatigue loading, and by allowing the bladder 14 to be refilled as necessary if pressure reduces over time. The exemplary EHA may also provide a bladder that is configured within the reservoir in a manner that prevents restriction of hydraulic fluid flow to the pump, such as by being anchored away from the pump inlet/outlet and/or by reducing engagement with the reservoir interior surfaces to prevent fluid from becoming trapped behind the bladder and inaccessible to the pump.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. An electro-hydraulic actuator comprising:

a reservoir having an interior space for containing a hydraulic fluid;

a bladder within the reservoir for containing a fixed amount of compressible gas, the bladder having an inlet/outlet port configured to communicate with a gas source external to the reservoir for filling the bladder with the fixed amount of the compressible gas;

a closure configured to close communication of the inlet/outlet port of the bladder with the external gas source, wherein the closure is configured remain closed during use of the electro-hydraulic actuator to maintain the fixed amount of the compressible gas within the bladder when in use;

a pump fluidly connected to the reservoir, the pump having one or more inlet/outlet ports in fluid communication with the reservoir; and an electric motor drivingly coupled to the pump.

2. The electro-hydraulic actuator according to claim 1, wherein a passage operatively connects the bladder inlet/outlet port with the external gas source.

3. The electro-hydraulic actuator according to claim 2, wherein the fluid passage includes a valve for controlling passage of the gas into or out of the bladder.

4. The electro-hydraulic actuator according to claim 1, wherein a conduit operatively connects the bladder inlet/outlet port with the external gas source, the conduit extending from inside of the reservoir to outside of the reservoir.

5. The electro-hydraulic actuator according to claim 4, wherein the conduit is attached to the bladder and positions the bladder within the reservoir such that the bladder is spaced from the pump inlet/outlet.

6. The electro-hydraulic actuator according to claim 4, wherein the conduit is attached to the bladder and positions the bladder within the reservoir such that hydraulic fluid proximal the pump inlet/outlet is communicable with the hydraulic fluid distal the pump inlet/outlet.

7. The electro-hydraulic actuator according to claim 6, wherein the conduit is a rigid stem extending through an outer wall of the reservoir, the rigid stem being sealingly secured to the reservoir; and wherein the rigid stem anchors the bladder within the reservoir in a manner that prevents the bladder from contacting the pump inlet/outlet.

8. The electro-hydraulic actuator according to claim 1, wherein the reservoir has a first end portion with interior surfaces defining a first region for containing hydraulic fluid proximal the pump inlet/outlet, an opposite second end portion with interior surfaces defining a second region for containing hydraulic fluid distal the pump inlet/outlet, and an intermediate portion with interior surfaces that connect the interior surfaces of the first portion with the interior surfaces of the second portion;

wherein the bladder is configured to contract to a minimum volume within the reservoir and compress the fixed amount of compressible gas within the bladder when the volume of hydraulic fluid in the reservoir is at a maximum, and wherein the bladder is configured to expand to a maximum volume within the reservoir and expand the fixed amount of compressible gas within the bladder when the volume of hydraulic fluid in the reservoir is at a minimum; and wherein, when the bladder is expanded to its maximum volume, the bladder is configured within the reservoir to be spaced apart from the interior surfaces of the intermediate portion of the reservoir to enable the hydraulic fluid in the first region proximal the pump inlet/outlet to communicate with the hydraulic fluid in the second region distal the pump inlet/outlet.

9. The electro-hydraulic actuator according to claim 1, wherein the external gas source is a source of compressed gas selected from at least one of a gas compressor and a compressed gas tank.

10. The electro-hydraulic actuator according to claim 1, wherein the pressure level of the compressible gas within the bladder is adjustable.

11. The electro-hydraulic actuator according to claim 10, wherein the compressible gas within the bladder is pressurized to an elevated pressure level sufficient to maintain an elevated pressure of the hydraulic fluid in the reservoir even when the level of hydraulic fluid in the reservoir is at a minimum.

12. The electro-hydraulic actuator according to claim 1, wherein a coupling connects the electric motor to the pump; and wherein the pump is located within the reservoir.

13. The electro-hydraulic actuator according to claim 12, comprising a piston-cylinder assembly having a piston axially movable within the cylinder that is in fluid communication with the pump to effect movement of the piston in response to fluid flow between the cylinder and the reservoir.

14. An electro-hydraulic actuator comprising:

a vessel having an interior space;

a separator element separating the interior space of the vessel into a first portion for containing a hydraulic fluid and a second portion for containing a fixed amount of compressible gas, the separator element having an inlet/outlet port configured to communicate with an environment external to the vessel for filling the second portion with the fixed amount of the compressible gas;

a closure configured to close communication of the inlet/outlet port of the separator element with the external environment, wherein the closure is configured remain closed during use of the electro-hydraulic actuator to maintain the fixed amount of compressible gas within the separator element when in use;

a pump connected to the vessel, the pump having one or more inlet/outlet ports communicating with the first portion of the housing; and an electric motor drivingly coupled to the pump.

15. The electro-hydraulic actuator according to claim 14, wherein the separation element is shiftable between a first state corresponding to a maximum volume of the first portion and a second state corresponding to a minimum volume of the first portion.

16. The electro-hydraulic actuator according to claim 14, wherein a conduit operatively connects the separator element inlet/outlet port with the external environment; and wherein the conduit is attached to the separator element and positions the separator element within the vessel such that the separator element is spaced from the pump inlet/outlet.

17. The electro-hydraulic actuator according to claim 14, wherein the vessel has a region for containing hydraulic fluid proximal the pump inlet/outlet and a region for containing hydraulic fluid distal the pump inlet/outlet; and wherein the separator element is configured within the reservoir to enable the hydraulic fluid proximal the pump inlet/outlet to communicate with the hydraulic fluid distal the pump inlet/outlet.

18. An electro-hydraulic actuator comprising:

a reservoir for containing a hydraulic fluid;

a pump fluidly connected to the reservoir, the pump having one or more inlet/outlet ports in fluid communication with the reservoir;

an electric motor drivingly coupled to the pump; and a bladder within the reservoir for containing a compressible gas, the bladder being connected in the reservoir in a manner that prevents the bladder from obstructing flow to the pump inlet/outlet;

wherein the reservoir has a first end portion with interior surfaces defining a first region for containing hydraulic fluid proximal the pump inlet/outlet, an opposite second end portion with interior surfaces defining a second region for containing hydraulic fluid distal the pump inlet/outlet, and an intermediate portion with interior surfaces that connect the interior surfaces of the first portion with the interior surfaces of the second portion;

wherein the bladder is configured to contract to a minimum volume within the reservoir and compress the compressible gas within the bladder when the volume of hydraulic fluid in the reservoir is at a maximum, and wherein the bladder is configured to expand to a maximum volume within the reservoir and expand the fixed amount of compressible gas within the bladder when the volume of hydraulic fluid in the reservoir is at a minimum; and wherein, when the bladder is expanded to its maximum volume, the bladder is configured within the reservoir to be spaced apart from the interior surfaces of the intermediate portion of the reservoir to enable the hydraulic fluid in the first region proximal the pump inlet/outlet to communicate with the hydraulic fluid in the second region distal the pump inlet/outlet.

19. The electro-hydraulic actuator according to claim 18, wherein the bladder is anchored within the reservoir with a stem that attaches the bladder to an adjacent wall of the reservoir.

20. The electro-hydraulic actuator according to claim 18, wherein the bladder has an inlet/outlet port configured to communicate with a gas source external to the reservoir for filling the bladder with a fixed amount of the compressible gas; and wherein the electro-hydraulic actuator further comprises a closure configured to close communication of the inlet/outlet port of the bladder with the external gas source, wherein the closure is configured remain closed during use of the electro-hydraulic actuator to maintain the fixed amount of the compressible gas within the bladder when in use.

* * * * *